United States Patent [19]

Brandigampola

[11] 4,300,140

[45] Nov. 10, 1981

[54] COIL LOADED ANTENNA EMBEDDED IN GLASS FIBRE

[75] Inventor: Don E. Brandigampola, Guelph, Canada

[73] Assignee: Valcom Limited, Guelph, Canada

[21] Appl. No.: 136,694

[22] Filed: Apr. 2, 1980

[30] Foreign Application Priority Data

Feb. 26, 1980 [CA] Canada ..... 346451

[51] Int. Cl.[3] ..... H01Q 1/36; H01Q 1/40

[52] U.S. Cl. ..... 343/873; 343/895; 343/900

[58] Field of Search ..... 343/715, 749, 895, 900, 343/872, 873

[56] References Cited

U.S. PATENT DOCUMENTS

| | | | |
|---|---|---|---|
| 2,841,789 | 7/1958 | Bassett | 343/749 |
| 2,966,678 | 12/1960 | Harris | 343/895 |
| 2,972,744 | 2/1961 | Rickards et al. | 343/900 |
| 3,099,010 | 7/1963 | Taylor | 343/749 |
| 4,104,639 | 8/1978 | Muchiarone | 343/900 |

*Primary Examiner*—Eli Lieberman

*Attorney, Agent, or Firm*—George A. Rolston; William F. Frank

[57] ABSTRACT

A freestanding glass fibre antenna having at least two antenna sections, a lower section having a mounting base and a coupling at the upper end, and having linear radiating members of conductive material, and an upper section having a cooperating coupling at the lower end, and incorporating a single radiating element formed of conductive material, arranged in a helically wound coil fashion having a plurality of turns, and embedded permanently in the glass fibre material of such antenna, the coil wound radiating element being arranged to tune the antenna to the desired frequency range.

6 Claims, 5 Drawing Figures

COIL LOADED ANTENNA EMBEDDED IN GLASS FIBRE

The invention relates to a free-standing antenna formed of reinforced glass fibre material, and in particular to such an antenna incorporating a single helically wound radiating coil of conductive material therein.

BACKGROUND OF THE INVENTION

One form of free-standing glass fibre antenna is shown in U.S. Pat. No. 3,725,944.

The antenna disclosed there is formed of multiple layers of glass fibres laid up in a certain manner, and incorporates a plurality of radiating members extending in a generally longitudinal linear fashion up the antenna.

Antennas made in accordance with such patent, were found to be greatly superior to other free-standing antennas which had hitherto been available, and were able to withstand stresses due to weather, wind and the like, to a greater extent than any previous antennas then available.

Such antennas are particularly useful in military applications, in particular in mobile military applications such as at sea, or in situations where a powerful long-distance antenna must be set up and in operation at very short notice.

When they are subject to repeated bending stresses, for example due to high winds, or due to violent movement of the base upon which they are mounted, i.e., a ship in a rough seal, substantial stresses are imposed in the radiating conductors. Accordingly, a plurality of such conductors, all of them being generally linear members are employed. In this way, even through some such conductors would gradually break down, under repeated flexing of the antenna, the antenna would continue to function.

However, the use of a plurality of radiating members, of a generally linear nature, arranged spaced apart radially around the structure of the antenna imposes certain limitations on the effectiveness of the antenna for radiating radio transmissions.

It is of course well known that an antenna must be tuned to the resonant frequency of the transmission. This may be done by varying the length of the antenna, in simple cases. However, in the present invention, the length of the antenna is determined initially in the design stage and once erected, it cannot be changed. Tuning of the antenna is therefore usually effected by the use of a coil, connected at the base of the antenna. In the present case, where very high powered transmissions are involved, this introduces further problems and limitations, and also adversely affects the radiation characteristics of the antenna itself.

BRIEF SUMMARY OF THE INVENTION

The invention therefore seeks to overcome the disadvantages described above, by the provision of a free-standing glass fibre antenna, comprising at least two antenna sections, a lower one of such sections having a mounting base thereon at the lower end, and a coupling at the upper end, and having a plurality of linear radiating members of conductive material, and an upper one of such sections having a cooperating coupling at the lower end, and an upper one of such sections incorporating a single radiating element formed of conductive material, arranged in helically wound coil fashion having a plurality of turns, and embedded permanently in the glass fibre material of such antenna, said coil wound radiating element thereby tuning said antenna to the desired frequency range.

More specifically, the invention provides such an antenna incorporating male and female couplings and conductive junction means in such male and female couplings, and wherein said radiating members and said radiating element are in electrical connection therewith, whereby to constitute a continuous single electrical radiating structure, comprised of such coil wound element and said linear members.

The invention further provides such an antenna wherein the electrical connection between said radiating member and said conductive coupling, comprises a plurality of relatively short and separate conductive connecting members, all being connected to said coil wound radiating element, and extending therefrom, and being located at spaced intervals around said antenna, and connected to said conductive coupling at spaced intervals therearound.

More particularly, it is the object of the invention that, where three or more antenna sections are employed, the coil-wound radiating element shall be located in the second such section, counting from the base, i.e., the section next adjacent to the base section.

It will of course be understood that the helically wound radiating element is engineered in such a manner as to maximize the transmitting efficiency of the antenna over a predetermined wave band of desired transmission.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
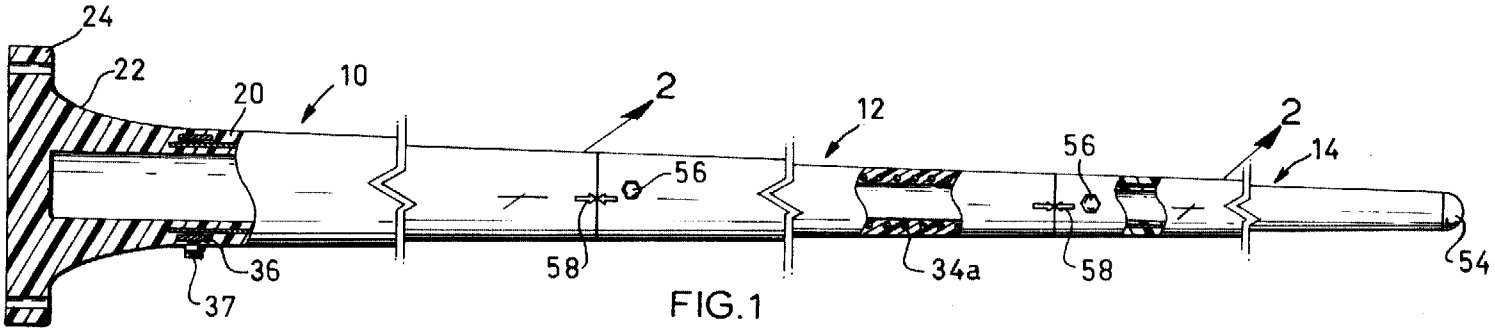
FIG. 1 is a fragmentary front elevation of a three-part antenna, shown with one joint and the base thereof cut away.
Figure 5:
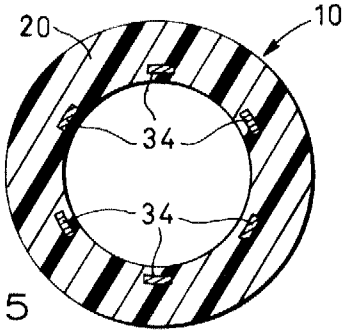
Figure 4:
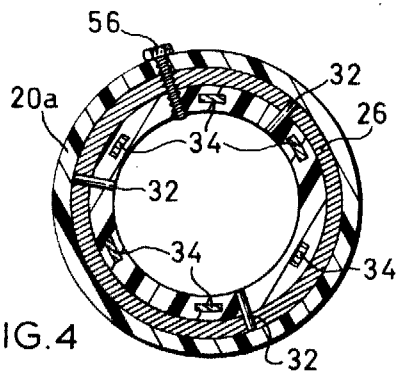
FIG. 4 is a transverse sectional view taken along the line 4—4 of FIG. 2, and, FIG. 5 is a section along line 5.
Figure 3:
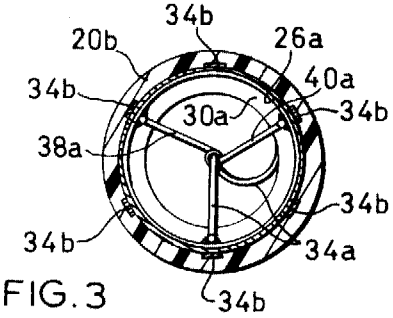
FIG. 3 is a transverse sectional view taken along the line 3—3 of FIG. 2.
Figure 2:
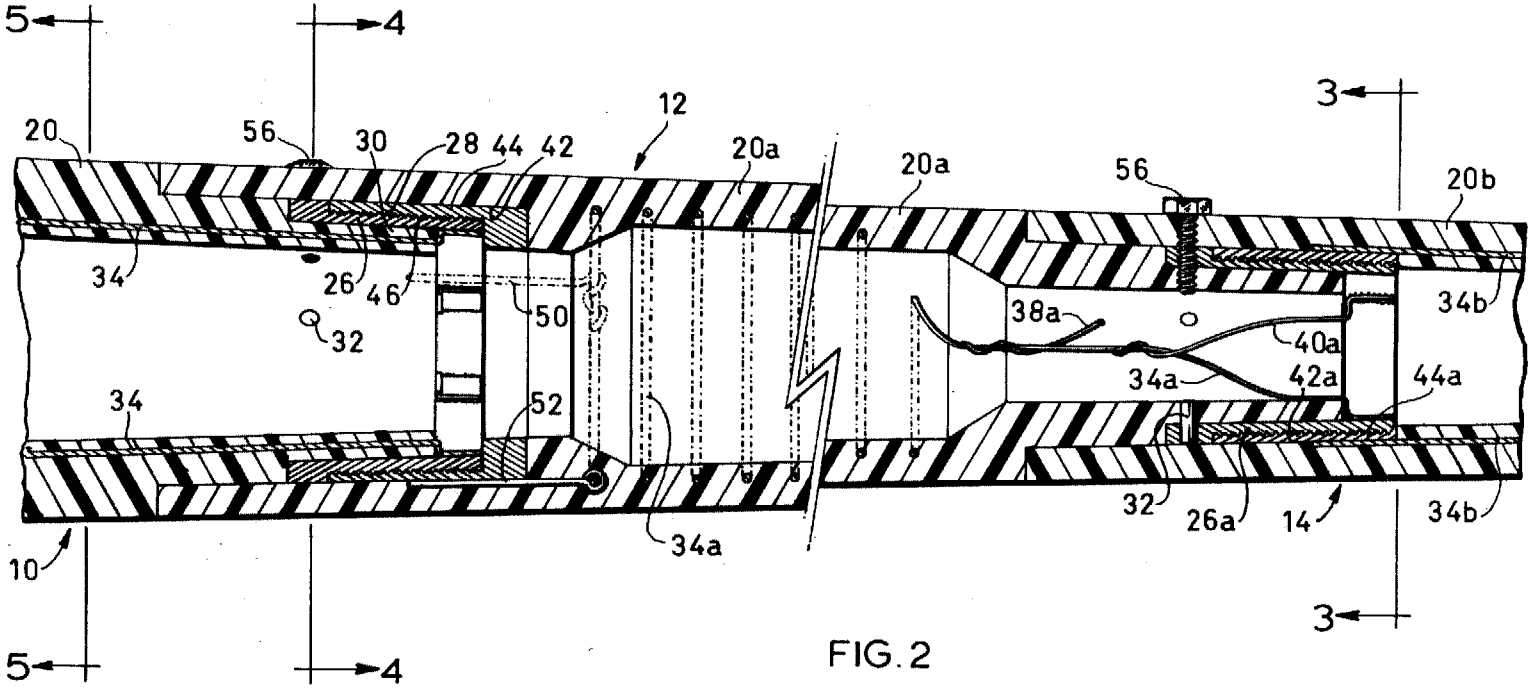
FIG. 2 is a fragmentary axial sectional view taken along the line 2—2 of FIG. 1.

As shown in the drawings, the present embodiment of the invention comprises an antenna formed in three sections, namely a bottom section or part 10, an intermediate section or part 12 and a top section or part 14.

It will of course be appreciated that the antenna can equally well be made with a two-part construction, or could have a four-part or five-part construction, or even more for certain purposes.

The bottom section 10 comprises a generally cylindrical hollow body portion 20, formed of reinforced glass fibre material, and a generally flared base 22, having a fastening flange 24 therearound also formed integrally of such glass fibre material.

The structure may be formed of multiple layers of glass fibre material, with the strands or rovings extending in different directions, as disclosed in the aforesaid U.S. Patent referred to above.

At its upper end, the bottom section 10 is provided with a male coupling sleeve 26, having exterior threads 28 formed therearound.

Coupling 26 is positioned on the upper end of the main body 20, the main body 20 being formed with an integral reduced diameter neck portion 30, adapted to fit tightly within the coupling 26.

A plurality of fastening pins 32 extend through suitable openings in the male coupling sleeve 26, and are bonded into the neck portion 30, so as to secure the coupling sleeve 26 in position.

In the majority of cases the coupling sleeve 26 will, of course, additionally be bonded in place by adhesive e.g. an epoxy adhesive to the glass fibre material of the neck 30.

Bottom section 10 incorporates a plurality of more or less linear conductive radiating elements 34 embedded in glass fibre material of main body 20. The conductive elements 34 are connected by a ring-like connector 36, at their lower end, and ring 36 is provided with an electrical coupling device 30, by means of which it may be coupled to a transmitter unit (not shown).

The upper ends of elements 34 are connected to the male coupling sleeve 26, being located radially spaced apart around the upper end of the main body 20, and extending through neck 30 into electrical connection with the interior of the male sleeve 26.

Male sleeve 26 is itself, of course, made of metal, and is therefore an electrically conducting member.

Preferably, the elements 34 will all be fastened, for example, by soldering to the interior of the male sleeve 26 which extends beyond the end of the neck 30.

The central section 12 of the antenna is also of similar glass fibre construction, having a main body portion **20*a*, and having at its upper end, a reduced neck 30*a*, and a male coupling sleeve 26*a*** provided with threads.

In this section of the antenna, the use of linear conductive elements 34 is dispensed with and instead a single conductive radiating element **34*a* is employed. Element 34*a* is embedded in the glass fibre material of the main body 20*a*, and is wound in a continuous helical manner so as to form a single winding continuous coil-like structure with a plurality of turns along the length of main body 20*a*. The individual turns of element 34*a*** are spaced apart from one another and are secured in such spacing by the surrounding glass fibre material.

The electrical conductor **34*a* is provided with two additional upper terminal connecting members 38*a* and 40*a*, which are equally spaced apart with the upper end of conductor 34*a* radially around the reduced neck 30*a*, and extend therethrough, together with the end of the conductor 34*a* itself, into electrical contact with the interior of the sleeve 26*a*** and are soldered thereto.

At the lower end of the main body portion **20*a*, an enlarged interior bore 42 is provided in the glass fibre material, in which is fitted a female coupling sleeve 44, having interior threads 46** therein.

The exterior of the sleeve 44 is provided with a series of axially spaced apart annular ridges or grooves 48, for the purpose of making a firmer and more secure engagement with the reinforced glass fibre material surrounding the enlarged bore 42, in which the sleeve 44 is received.

At its lower end, the conductor **34*a* is itself terminally connected to the exterior female sleeve 44, and two additional end connectors 50 and 52 are embedded in the body 20*a* attached to the conductor 34*a*, and are also connected to sleeve 44, in radially spaced apart location therearound, on its exterior, preferably with solder. Sleeve 44 being formed of metal is therefore electrically conductive, and it will thus be seen that a continuous electrical connection exists between the radiating elements 34 in the bottom section 10, via the upper male sleeve 26, through the female sleeve 44, to the single radiating element 34*a* in the centre section 12, and then to the male sleeve 26*a*** at the upper end of the centre section.

It will also be noted that the male sleeve **26*a* is similarly fastened by means of pins, and adhesive (not shown) to the neck 30*a***.

The upper or top portion 14 of the antenna 10 is also provided with a main body **20*b*, and having at its lower end, an enlarged bore 42*a*, into which is received a female sleeve 44*a*, having interior threads and exterior annular grooves in the same manner as sleeve 44. This section of the antenna uses a plurality of generally linear conductive radiating elements 34*b*, in the same way as bottom section 10**.

The lower end of conductive members **34*b* are terminally connected to the sleeve 44*a*. Sleeve 44*a* being of metal and therefore electrically conductive, therefore provides a continuous connection between male sleeve 26*a* and the conductive members 34*b***.

Conductive members **34*b* extend upwardly along the length of the upper main body portion 20*b*, and are fastened at the top end thereof, to a suitable metallic convex typically hemispherical member, shown generally as 54**.

Fastening bolts 56 extend through suitable threaded bores in the ends of the main body portions 20 and **20*a* and through sleeves 44 and 26** to lock the sections together.

Visual markings or indicia 58 on the exterior provide an easy means of ensuring that the couplings are correctly fastened, sufficiently tightly to ensure proper interconnection but not so overly tight as to cause possible damage to the structure.

In the past, for example when using with antennas such as those illustrated in U.S. Pat. No. 3,725,944, it was possible to construct freestanding antennas which were tuned to operate at fairly low frequencies, in the range of between 2 and 30 megahertz. However, it was generally speaking impractical to attempt to construct such an antenna which would be tuned to operate at frequencies much below this range.

In accordance with the invention however it is now possible to construct a whip antenna which is tuned to radiate very low frequencies, in the range from about 300 kilohertz, up to 2 megahertz, and at high power, in the range of 10 kilowatts, with great efficiency. The whip antenna of the invention, by the use of the intermediate section incorporatins a coil-wound radiating element, is effectively tuned to the resonant frequency range most suitable for low frequencies, for which it is used.

Coil loading of the antenna at its base would not be as effective, since in this location the coil would generate a high voltage at the feed point when the whip is operated at low frequency. Most antenna couplers cannot handle the high feed point voltage developed at low frequencies.

In accordance with the invention, the inductive loading is located in the middle of the antenna and reasonably far away from the feed point. In this way, the feed point voltage is maintained within acceptable limits, and in addition, the radiation characteristics along the length of the antenna are optimized so as to produce the most favourable profile.

As mentioned above, such antennas may be made in four or five sections. In the case where the antenna is more than three sections, then it is desirable that the coil wound radiating element 34*a* shall be contained in the second section of the antenna, i.e., the section next adjacent to the base or bottom section.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A free standing glass fibre antenna which comprises:

at least two elongated antenna sections;

a mounting base at the lower end of a lower said antenna section;

mating electrically conductive male and female couplings interconnecting said antenna sections;

conductive radiating element means embedded in a lower one of said sections;

a single radiating element means of electrically conductive material arranged in a helically wound coil manner and having a plurality of turns, embedded in the glass fibre material of an upper one of such sections, and, connector portions at each end of said single coil wound radiating element adjacent respective said couplings, and terminally connected to a respective one of said male and female couplings;

at least one other conductive member secured to said coil wound radiating element means at each end thereof and in turn connected to respective ones of said couplings whereby said radiating element means of all said antenna sections are electrically interconnected through said male and female couplings to provide a single and continuous electrical radiating structure.

2. A free standing glass fibre antenna as claimed in claim 1 and in which said radiating elements in said antenna sections are terminally connected to respective ones of said male and female couplings at a plurality of positions around each such coupling.

3. A free standing glass fibre antenna as claimed in claim 1 and in which said male and female couplings are adapted threadingly to interengage each other.

4. A free standing glass fibre antenna as claimed in claim 3 and which additionally comprises locking means between each pair of antenna sections for the purpose of preventing disengagement of said male and female couplings thereat.

5. A free standing glass fibre antenna as claimed in claim 4 and in which indicia are provided externally on end portions of adjacent antenna sections to indicate proper interengagement of said male and female couplings.

6. A free standing glass fibre antenna as claimed in claim 1 wherein there are at least three antenna sections, and wherein said coil wound radiating element means is located in the section next adjacent the base section.

* * * * *